US007500388B2

(12) United States Patent
Fujisawa et al.

(10) Patent No.: US 7,500,388 B2
(45) Date of Patent: Mar. 10, 2009

(54) METHOD AND APPARATUS FOR IN-SITU SIDE-WALL CORE SAMPLE ANALYSIS

(75) Inventors: Go Fujisawa, Sagamihira (JP); Oliver C. Mullins, Ridgefield, CT (US); Peter David Wraight, Skillman, NJ (US); Joel Lee Groves, Leonia, NJ (US); Lennox Reid, Houston, TX (US); Felix Chen, Newtown, CT (US); Gary Corris, Newtown, CT (US); Yi-Qiao Song, Ridgefield, CT (US)

(73) Assignee: Schlumberger Technology Corporation, Cambridge, MA (US)

( * ) Notice: Subject to any disclaimer, the term of this patent is extended or adjusted under 35 U.S.C. 154(b) by 360 days.

(21) Appl. No.: 11/304,296

(22) Filed: Dec. 15, 2005

(65) Prior Publication Data

US 2007/0137894 A1 Jun. 21, 2007

(51) Int. Cl.
*E21B 49/00* (2006.01)

(52) U.S. Cl. ..... 73/152.11

(58) Field of Classification Search ..... 73/152.46, 73/152.14, 152.11

See application file for complete search history.

(56) References Cited

U.S. PATENT DOCUMENTS 4,339,947 A * 7/1982 Wiley ..... 73/864.44
4,466,495 A * 8/1984 Jageler ..... 175/59
4,609,056 A * 9/1986 Colle et al. ..... 175/4
4,702,168 A * 10/1987 Colle et al. ..... 102/313
5,411,106 A * 5/1995 Maissa et al. ..... 175/78
5,417,104 A * 5/1995 Wong ..... 73/38
5,439,065 A * 8/1995 Georgi ..... 175/59
5,670,717 A 9/1997 Lamine et al.
5,984,023 A 11/1999 Sharma et al. ..... 175/50
6,003,620 A 12/1999 Sharma et al. ..... 175/50

(Continued)

FOREIGN PATENT DOCUMENTS

GB 2225865 A 6/1990

(Continued)

OTHER PUBLICATIONS

Turner, R. "Gradient Coil Systems." *Encyclopedia of Nuclear Magnetic Resonance*. vol. 4, Ed. David M. Grant, Robin K. Harris. Chichester: John Wiley & Sons, 1996. pp. 2223-2233.

*Primary Examiner*—John Fitzgerald
(74) *Attorney, Agent, or Firm*—James McAleenan; Jody DeStefanis; Vincent Loccisano

(57) ABSTRACT

A wireline-conveyed side-wall core coring tool for acquiring side-wall core from a geological formation for performing in-situ side-wall core analysis. The coring tool has a core analysis unit operable to measure geophysical properties of an acquired side-wall core. The measured geophysical properties may be used to determine the success of the acquisition of side-wall cores by the coring tool. The core analysis unit is operable of performing an in-situ interpretation of measured geophysical property of the side-wall core and transmitting in near real-time the measurements or the interpretation results to surface data acquisition and processing apparatus.

22 Claims, 10 Drawing Sheets

U.S. PATENT DOCUMENTS

| | | | | |
|---|---|---|---|---|
| 6,220,371 | B1 | 4/2001 | Sharma et al. | 175/50 |
| 6,371,221 | B1 * | 4/2002 | Harrigan et al. | 175/26 |
| 6,462,542 | B1 | 10/2002 | Venkataramanan et al. | 324/303 |
| 6,570,382 | B1 | 5/2003 | Hurlimann et al. | 324/303 |
| 6,788,066 | B2 * | 9/2004 | Wisler et al. | 324/376 |
| 2003/0178994 | A1 | 9/2003 | Hurlimann et al. | 324/303 |
| 2005/0133267 | A1 | 6/2005 | Reid et al. | 175/58 |

FOREIGN PATENT DOCUMENTS

| | | | |
|---|---|---|---|
| GB | 2283261 | A | 5/1995 |
| WO | 97-49894 | A1 | 12/1997 |
| WO | 2005/086699 | A2 | 9/2005 |

* cited by examiner

METHOD AND APPARATUS FOR IN-SITU SIDE-WALL CORE SAMPLE ANALYSIS

TECHNICAL FIELD

The present invention relates generally to oilfield exploration and development, and more particularly, to analysis of cores obtained using coring tools.

BACKGROUND OF THE INVENTION

In the oil and gas industry, wells are drilled deep into the earth's crust for the purpose of finding and retrieving petrochemicals. Operating companies, who own or manage such wells, as well as oilfield services companies, evaluate wells in a variety of ways, for example, by acquiring formation cores. These formation cores may be obtained using coring tools—tools which may be conveyed on a wireline suspended into the well and which drills into the side-wall of the borehole to obtain formation samples, also known as cores.

The assessment of formation characteristics acquired from formation cores is often crucial to the decision-making process concerning development plans for petroleum wells that are being evaluated as part of an exploration or production activity. Take, for example, a well that has been drilled and evaluated by well logging or the acquisition of formation cores. Depending on the results of the evaluation, the well could be drilled deeper, plugged and abandoned as non-productive or cased and tested. The evaluation may also be inconclusive and the determination made that additional evaluation, for example, further acquisition of side-wall cores of the formation, is required before a decision on the disposition of the well can be made. The results of the core analysis as interpreted from a well log may also help determine whether the well requires stimulation or special completion technologies, such as gas lift or sand control. The decisions made from well evaluations are very difficult, often made with imperfect information, have huge economic impact, and frequently have to be made very quickly. Mistakes, or even mere delay, can be extremely expensive.

There are several different types of tools for obtaining side cores. One approach is to manipulate a rotating hollow cylindrical coring bit into the side-wall of the borehole. As the rotating coring bit is forced into the sidewall, a small sample of the formation, known herein as the core, is collected in the interior of the coring bit. An example of a side-coring tool is the Mechanical Side-Coring Tool (MSCT™) of Schlumberger Technology Corporation. Side-wall core samples are acquired by the MSCT™ using rotary drilling whereby no percussion damage is caused by rotary drilling into the side-wall of the borehole. The Mechanical Side Coring Tool is operable to acquire up to twenty side-wall core samples during a single trip into the borehole. The rotary drilling of the side-wall core by the MSCT™ preserves the properties of the side-wall core samples thereby allowing accurate measurements of parameters such as relative permeability and secondary porosity.

Production company personnel at a well site or other personnel involved in planning a logging job may plan for a side-wall coring job that involves acquiring side-wall cores for particular depths of interest. A coring tool is then lowered to the depth of interest and coring operations are performed at these depths. Core samples are collected in the tool and the entire apparatus retrieved to the surface. Upon retrieving the coring tool, these personnel may discover, to their dismay, that a fewer number of cores were actually acquired during the job than what was planned for. An additional problem from the failure to acquire all planned side-wall cores is a difficulty in sorting out which side-wall core associates to a specific planned depth of interest. Furthermore, the lack of core analysis in current coring tools result in delay in testing and updating any reservoir model until such time the acquired side-wall cores are analyzed in the laboratory.

Oil and gas wells can be extremely deep. It is not uncommon for the wells to be as much as 30,000 feet in vertical depth. Often a depth of interest is located near the bottom of such deep wells. Consequently, the operation of retrieving a wireline and its attached tool-string to the surface can be a very time consuming and expensive operation. The same can be said for the redeployment of the wireline and tools into the well to acquire additional information, be it geophysical measurements from sensors or additional core samples.

One method of in-situ analysis of cores captured in inline coring operations is disclosed in U.S. Pat. Nos. 6,220,371, 6,003,620 and 5,984,023 to Sharma et al. In an inline coring operation, core samples are obtained by a coring bit operating at the end of a core barrel extending in the borehole from the surface to the bottom of the well. Core samples are brought up to the surface in an inner core barrel located inside an outer core barrel. In the analysis system of Sharma et al., core samples are moved in the inner core barrel to the surface and the measurements of the core samples are taken as they move past an array of sensors. Coring at the end wall of the borehole and in the direction of the borehole is generally referred to as "conventional" coring. Multiple core acquisition is generally unavailable with conventional coring and would undesirably increase the cost and complexity of acquiring and analyzing of the multiple cores.

From the foregoing it will be apparent to those skilled in the art that there is a need for an improved method to monitor the acquisition of side-wall cores by a coring tool. Furthermore, knowledge that side-wall cores have been acquired at each specified depth of interest in the well is desirable. It will also be apparent to those skilled in the art that there is a need for an improved method to analyze the side-wall core while the core is still in the coring tool and the coring tool is still in the borehole. Furthermore, providing timely core analysis results, in near real-time, whereby the analysis results can be used to test and update any reservoir model based on the continuous log available at the wellsite. There is a further need to make core analysis results available in near real-time to decision-makers thereby permitting decisions as to which course of action to take with respect to the coring operation.

SUMMARY OF THE INVENTION

The present invention provides an improvement on the art of wireline-conveyed side-wall core coring operations in which measurements of geophysical properties of an acquired side-wall core may be performed in-situ during the progress of logging operations. These measurements of geophysical properties may be used to determine the success or failure of the acquisition of side-wall cores. The success or failure of the acquisition of a side-wall core at a particular depth of interest may factor in decisions to make a new attempt to acquire side-wall cores or to make some other decisions. Furthermore, in an alternative embodiment, the invention provides an apparatus and method whereby interpretation of the measurements may be performed in-situ. The result of the measurements and the interpretation thereof may be transmitted in near real-time to data acquisition and processing apparatus on the surface thereby providing timely and valuable information for personnel running the logging operations.

In one embodiment, the invention provides a wireline-conveyed coring tool for acquiring side-wall core from a geological formation while traversing a borehole in a well wherein the coring tool may be held stationary by an anchor shoe at selected depths of interest in the borehole to acquire a side-wall core. The coring tool has at least one mechanical coring unit operable to acquire a side-wall core from geological formation at one or more selected depths of interest in the borehole. The coring tool further has at least one core analysis unit operable to measure a geophysical property of the acquired side-wall core.

In one embodiment, the core analysis unit has at least one gamma-ray source for emitting photons and at least one gamma-ray detection unit operable to measure the change of gamma-ray count rate when an object crosses between the gamma-ray source and a gamma-ray detection unit. In another embodiment, the core analysis unit has at least one permanent magnet for creating a strong, static, magnetic-polarizing field for making a nuclear magnetic resonance measurement when the side-wall core traversing the path of the permanent magnet remains exposed to the magnetic field for the duration of the measurement. Nuclear magnetic resonance measurements may be used to determine the saturation, viscosity, presence of large molecules or composition properties of the oil in the side-wall cores. Alternatively, the measurements may be used to determine at least one porosity properties of the formation including porosity, permeability, wettability, or pore size or at least one porosity properties of the fluid including saturation, viscosity, presence of large molecules and composition properties of the fluid.

In other alternative embodiments, the core analysis unit has sensors for measuring other geophysical properties, for example, an electromagnetic property or an acoustic sensor.

Other aspects and advantages of the present invention will become apparent from the following detailed description, taken in conjunction with the accompanying drawings, illustrating, by way of example, the principles of the invention.

DETAILED DESCRIPTION OF THE INVENTION

Figure 1:
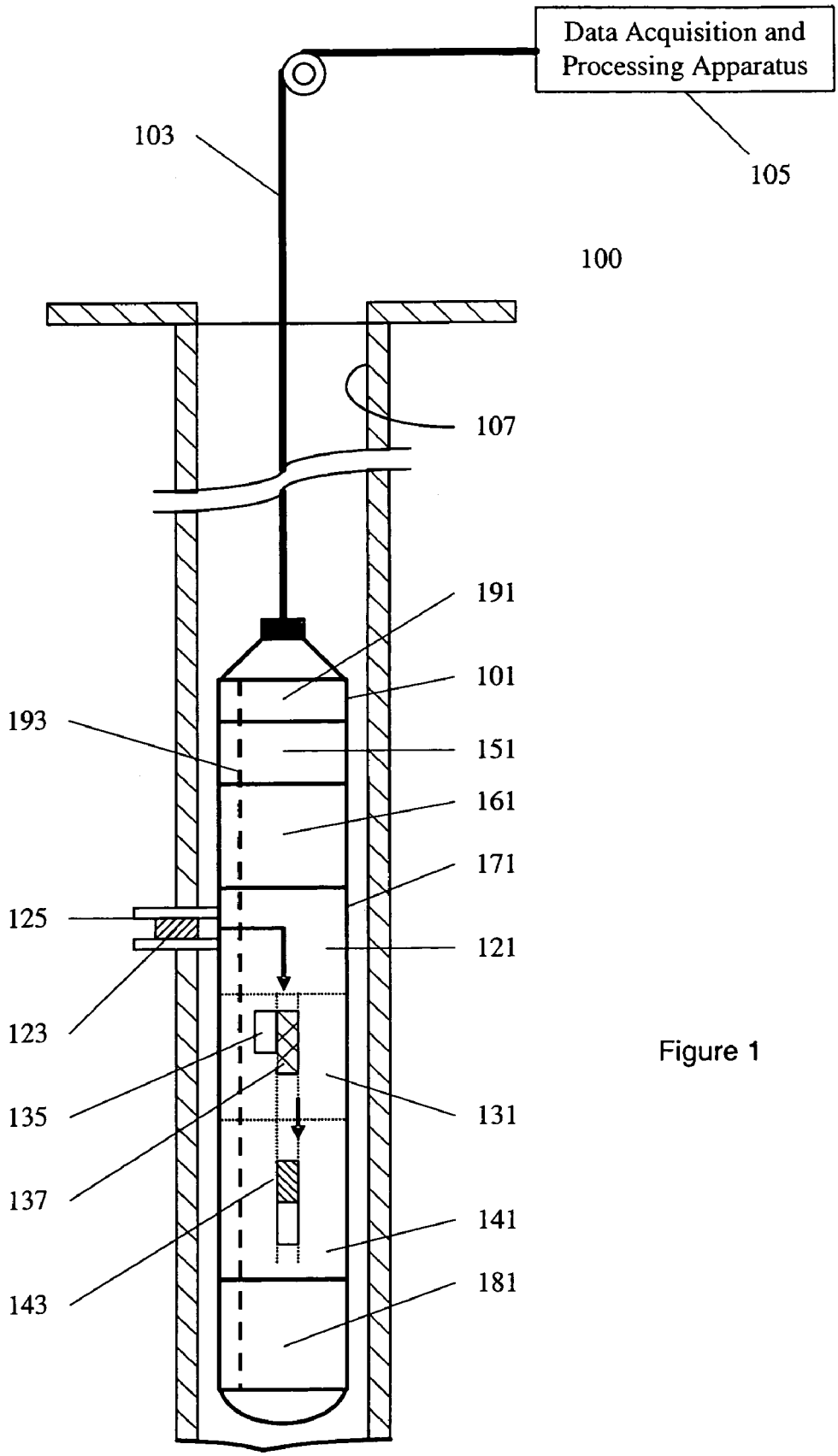
FIG. 1 is a schematic diagram illustrating a side-coring tool in a borehole with apparatus to monitor and analyze a side-wall core embodying the invention. This schematic shows the components as modules for ease of illustration; this configuration is intended to be non-limiting.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

I. Introduction

Coring is a process of removing an inner portion of a material by cutting with an instrument. While some softer materials may be cored by forcing a coring sleeve translationally into the material, for example soil or mud, harder materials generally require cutting with rotary coring bits, that is, hollow cylindrical bits with cutting teeth disposed about the circumferential cutting end of the bit. One skilled in the art would also recognize that the sleeve may not be required for all side-wall coring drilling applications. Coring is used in many industries to either remove unwanted portions of a material or to obtain a representative sample of the material for analysis to obtain information about the physical properties of the material. Coring is extensively used to determine the physical properties of downhole geologic formations encountered in mineral and petroleum exploration and development.

The present invention provides a near real-time side-wall core monitoring and analysis system in an embodiment of a side-coring tool that determines the success or failure of the acquisition of a side-wall core operation. If the acquisition of a side-wall core has failed at a selected depth of interest in the borehole, the near real-time feedback from the monitoring system provides an opportunity to acquire the side-wall core again and helps improve the performance of such a side-wall coring tool. The side-wall core analysis system of an embodiment of a side-coring tool of the present invention, calculates and provides such measurements as core bulk density, mineralogy of the core from the photoelectric effect and core porosity in near real-time in a continuous log available at the wellsite to test and update reservoir models.

The present invention is applicable to in-situ analysis of acquired side-wall cores of the formation during wireline side-wall coring operation. The in-situ analysis provides near real-time information of downhole geologic formation properties that are received at the data acquisition and processing apparatus on the surface while the logging job is still progressing. Therefore, for example, the analysis results of acquired side-wall cores may be used to test and update a reservoir model without the usual wait for a lengthy laboratory core analysis required in a conventional coring job. One embodiment of the invention is a side-coring tool that can analyze the acquired formation side-wall cores, thereby, providing timely near real-time information that may be used by well-site personnel to modify a planned core-sampling job or to assure acquisition of all side-wall cores at each specified depth of interest in a borehole.

FIG. 1 is a diagram of a wireline logging system 100 having a side-wall coring tool 171. In wireline well logging, one or more tools containing sensors for taking geophysical measurements are connected to a wireline 103, which is a power and data transmission cable that connects the tools to a data acquisition and processing apparatus 105 on the surface. The tools connected to the wireline 103 are lowered into a well borehole 107 to obtain measurements of geophysical properties for the area surrounding the borehole. The side-wall coring tool 171 can be part of a tool string 101 comprising several other tools 151, 161 and 181. However, for the sake of clarity, only detail of the side-wall coring tool 171 is illustrated in FIG. 1. The wireline 103 supports the tools by supplying power to the tool string 101. Furthermore, the wireline 103 provides a communication medium to send signals to the tools and to receive data from the tools.

The tools 151, 161, 171, and 181 are typically connected via a tool bus 193 to a telemetry unit 191 which in turn is connected to the wireline 103 for receiving and transmitting data and control signals between the tools 151, 161, 171, 181, and the surface data acquisition and processing apparatus 105.

Commonly, the tools are lowered to a particular depth of interest in the borehole and are then retrieved by reeling-in by the data acquisition and processing apparatus 105. As the tools are retrieved from the well borehole 107, the tools collect and send data via the wireline 103 about the geological formation through which the tools pass, to the data acquisition and processing apparatus 105 at the surface, usually contained inside a logging truck or a logging unit (not shown).

The coring tool is described in greater detail in complimentary art, co-pending and co-assigned U.S. patent application Ser. No. 10/707,505, entitled, "CORING TOOL WITH RETENTION DEVICE" of Lennox E. Reid Jr., Rachel Lavaure, and Dean Lauppe, the entire disclosure of which is incorporated herein by reference.

II. Wireline Coring Tool

The wireline side-coring tool 171, as implemented in one embodiment of the invention, contains at least one mechanical coring section 121, at least one core analysis section 131, and at least one core storage section 141. The wireline side-coring tool 171 is operable to acquire multiple side-wall core samples during a single trip to the borehole. This embodiment is illustrated in FIG. 1. When the wireline side-coring tool 171, which may be part of a tool string 101, is lowered into a well borehole 107 to a depth of interest 125, the mechanical coring section 121 acquires a side-wall core 123 from the borehole 107. The mechanical coring section 121 covers the acquired side-wall core 123 in a protective canister 137 and conveys the protective canister 137 containing side-wall core 123 to the core analysis section 131. The core analysis section 131 in one embodiment of the invention consists of at least one geophysical-property measuring unit 135. The geophysical-property measuring unit 135 is connected via the tool bus 193 to the telemetry unit 191 for transmission of data to the data acquisition and processing apparatus 105 at the surface via the wireline 103.

In one embodiment of the invention, the geophysical-property measuring unit 135 may be a gamma-ray detection unit that measures change in gamma-ray count rate as an object, specifically, a protective canister 137 containing (or not containing) a side-wall core 123, crosses the measurement area of the gamma-ray detection unit 135. In that embodiment of the invention, the protective canister 137 containing a side-wall core 123 is slowly conveyed in the measurement path of the gamma-ray detection unit 135. Also in that embodiment of the invention, the gamma-ray detection unit 135 records changes in gamma-rate count rate and transmits this information to the data acquisition and processing apparatus 105 on the surface. After analysis of the side-wall core is completed, the core analysis section 131 conveys the acquired side-wall core 143 to a storage section 141 of the side-coring tool 171. Furthermore, the acquired side-wall cores are stored in the storage section 141 of the side-coring tool 171 for retrieval when the tool string 101 is reeled to surface from the well borehole 107.

In an alternate embodiment of the invention, the geophysical-property measuring unit comprises sensors that measure nuclear magnetic resonance signals to gather geologic formation properties of the side-wall core when a protective canister 137 containing side-wall core 123 crosses the measurement area of a the detection unit 135.

In yet another embodiment of the invention, the detection unit 135 may be another type of sensor that may be used to measure geophysical properties. Examples of such sensors include sensors that measure electromagnetic signals to gather geologic formation properties of the side-wall core when a protective canister 137 containing side-wall core 123 crosses the measurement area of the detection unit 135 and sensors that measure acoustic signals to gather geologic formation properties of the side-wall core when a protective canister 137 containing side-wall core 123 crosses the measurement area of the detection unit 135.

III. Core Analysis

In one embodiment of the invention, the core analysis section 131 of the side-coring tool 171 use gamma-ray technology to analyze acquired cores. In another embodiment of the invention, the core analysis section 131 of the side-coring tool 171 uses nuclear magnetic resonance technology for the purpose of analyzing acquired cores. As discussed herein above, yet other measuring technologies are possible. For such technologies, core analysis sections analogous to those presented herein below would be present using sensors suitable for such technologies.

III.1. Gamma-Ray

Figure 2:
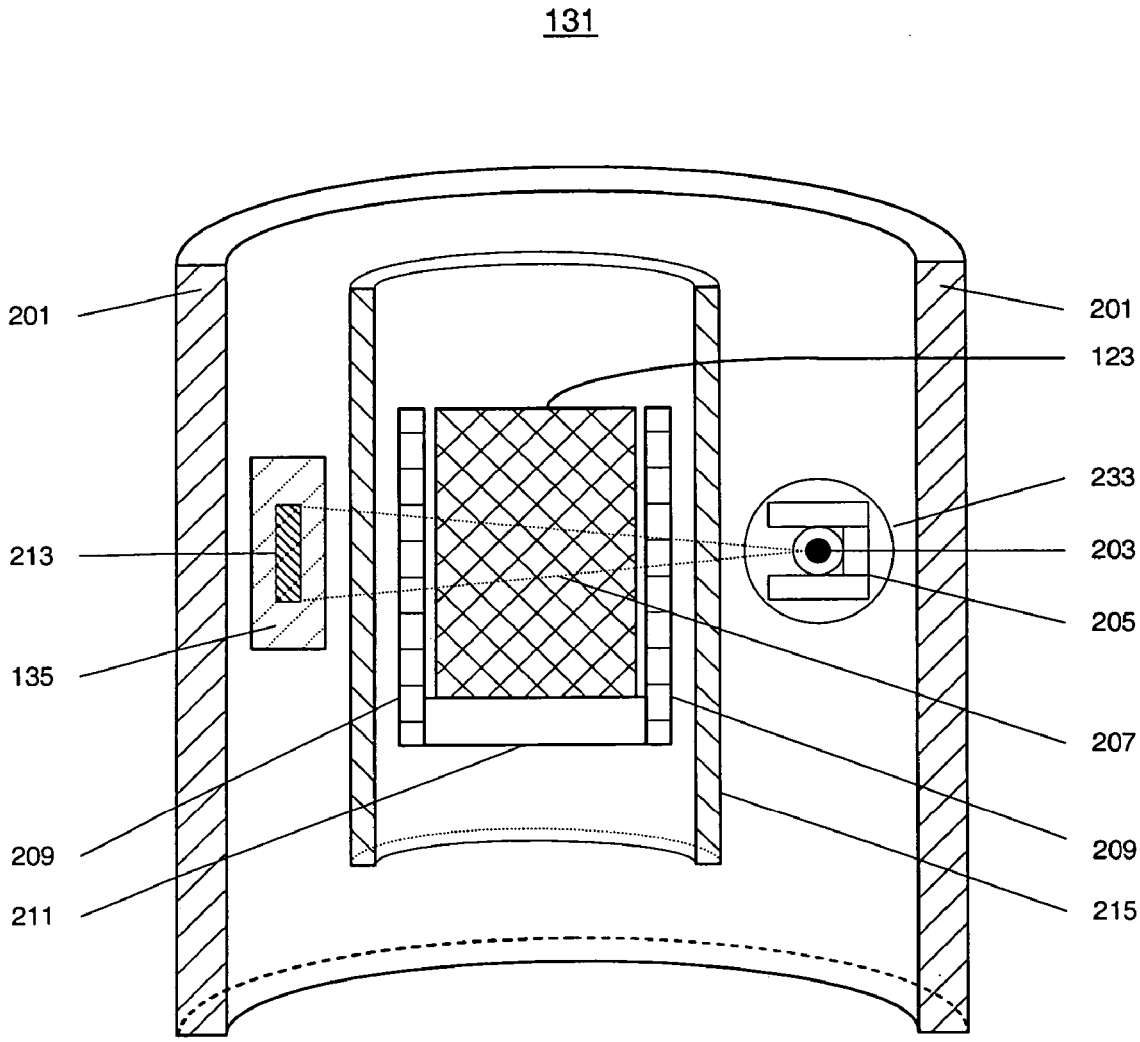
FIG. 2 is a detailed drawing of the core analysis section of the side-coring tool illustrated in FIG. 1.

FIG. 2 is a cross-sectional view of the core analysis section 131 of the side-coring tool 171 illustrated in FIG. 1. While the detection unit 135 may be any one of several types of sensors used for measuring geophysical properties, in the embodiment illustrated in FIG. 2, by way of example, the detection unit 135 is operable to detect a signal transmitted from an energy source, e.g., a radioactive emission. The analysis of the side-wall core is achieved, in the exemplary embodiment of the invention illustrated in FIG. 2, by measuring signal strength emitted from an energy source 233 or changes in detected energy in the detection unit 135, when an object, for example, an acquired side-wall core 123 in a protective canister 137, traverses across the measurement path between the energy source 233 and the detection unit 135. In one such embodiment of the invention, the energy source 233 may be a gamma-ray source consisting of $^{133}$Ba gamma-ray source 203 inside a titanium alloy housing 205. The housing 205 insulates the $^{133}$Ba gamma ray source 203 from borehole high pressure and potentially corrosive borehole fluid. A tungsten alloy collimator holds the gamma ray source housing 205 wherein the gamma-ray source 203 emits photons propagating in a collimated cone 207 along the direction of a gamma-ray detecting element 213 inside the gamma-ray detection unit 135. The count of gamma-ray photons detected by the gamma-ray detection unit 135 may be classified as either high-energy or low-energy. In one embodiment of the invention, high-energy group level main peak is at 356 keV (keV referring to kiloelectron volts), which is used for core density measurement. Furthermore, in that embodiment of the invention, low-energy group level is at 81 keV, which is more sensitive to photoelectric effect (Pe). The number of gamma-ray photons emitted from the gamma-ray source 203 and reaching the gamma-ray detector element 213 inside the gamma-ray detection unit 135 is influenced by the density and photoelectric (Pe) cross section of the medium that lies in the path traversed by the gamma-ray photons in the collimated cone 207. The acquired side-wall core 123 in a protective canister 137 is in the path of the collimated cone 207, illustrated in FIG. 2 resulting in reduced gamma-ray count rate at the gamma-ray detection unit 135 due to scattering of photons from charged particles herein referred to as Compton scattering and photoelectric effect. The details of interpreting the photon count rates in terms of the physical properties of the acquired side-wall cores are discussed herein below under the heading "Interpretation of Core Analysis Results".

In a preferred embodiment of the invention, the protective canister side-wall 209 is a light material (i.e., the side-wall material has a low atomic number (Z)) thereby having optimum gamma-ray transparency. In an alternative embodiment of the invention, the protective canister side-wall 209 material is PEEK (plastic material Polyshell-12). In an alternative embodiment, suitable for use if corrosion is not an issue in the hostile coring tool environment in the well borehole, aluminum is used for the protective canister side-wall 209. In one embodiment of the invention, the protective canister bottom 211 may be heavy material and having a thickness to maximize the contrast of detected gamma-ray count rate as compared to the acquired side-wall core 123, thereby making convenient the identification of the starting point of the protective canister bottom 211 and the side-wall core 123 when protective canister 137 containing the side-wall core 123 is conveyed from mechanical coring section 121 to core analysis section 131. In this embodiment of the invention, protective canister 137 has an outer diameter (OD) of 1.6 inches, an inner diameter of 1.52 inches and inner length of 3.03 inches.

Figure 3:
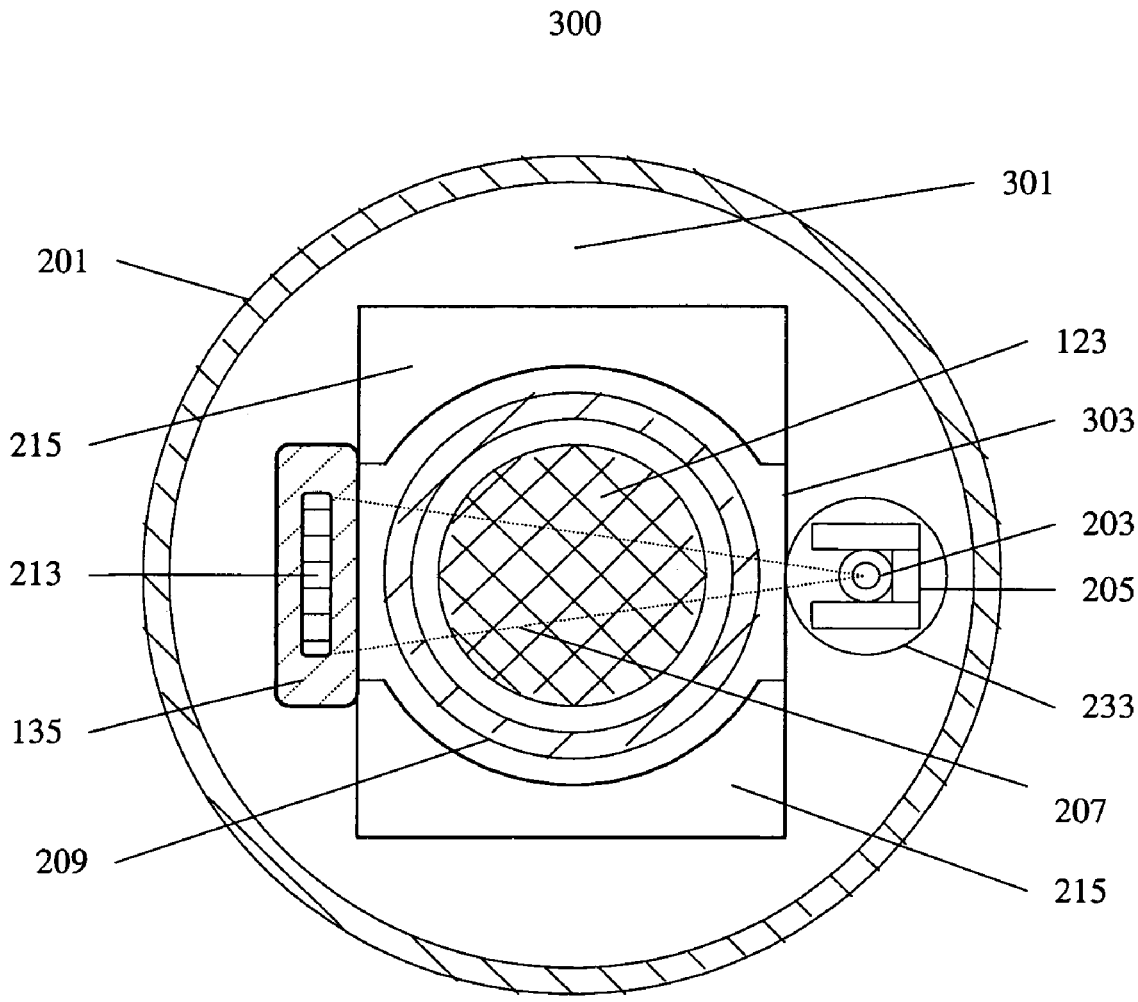
FIG. 3 is the cross-sectional view of one embodiment of the core analysis section shown in FIG. 2, illustrating details of the energy source and energy detection unit.

FIG. 3 is a cross-sectional view 300 of the core analysis section 131 of the side-coring tool 171 illustrated in FIG. 1. However, for the sake of clarity only details of the area in the vicinity of energy source 233 and energy detection unit 135 are illustrated in FIG. 3. In one embodiment of the invention, the position of the protective canister 137 containing the side-wall core 123 is fixed by a core-guiding block 215. When the protective canister 137 is conveyed in the path across the direction of gamma-ray emissions from the gamma-ray source 203 to the gamma-ray detection unit 135, the core-guiding block 215 ensures accurate placement of the canister 137 and the side-wall core 123 with respect to the gamma-ray source 203 and the gamma-ray detection unit 135, thereby providing high accuracy of gamma-ray count rate measurement. Furthermore, an opening slit 303 in the core-guiding block 215 in the area of gamma-ray source 203 and gamma-ray detection unit 135 provides reduction of gamma-ray attenuation by the core-guiding block 215. In one embodiment, pressure inside the coring-tool 171 is equivalent to the pressure in the borehole 107. In that embodiment, the gamma-ray detection unit 135 is packaged in a material to withstand the pressure inside 301 the coring-tool 171 and, thus, keeping to a minimum the gamma-ray attenuation due to the side-wall material of the gamma-ray detection unit 135. In a preferred embodiment of the invention, the side-wall of the gamma-ray detection unit 135 covering gamma-ray detecting element 213 is titanium or a material having similar properties thereto.

III.2. Nuclear Magnetic Resonance

Figure 4:
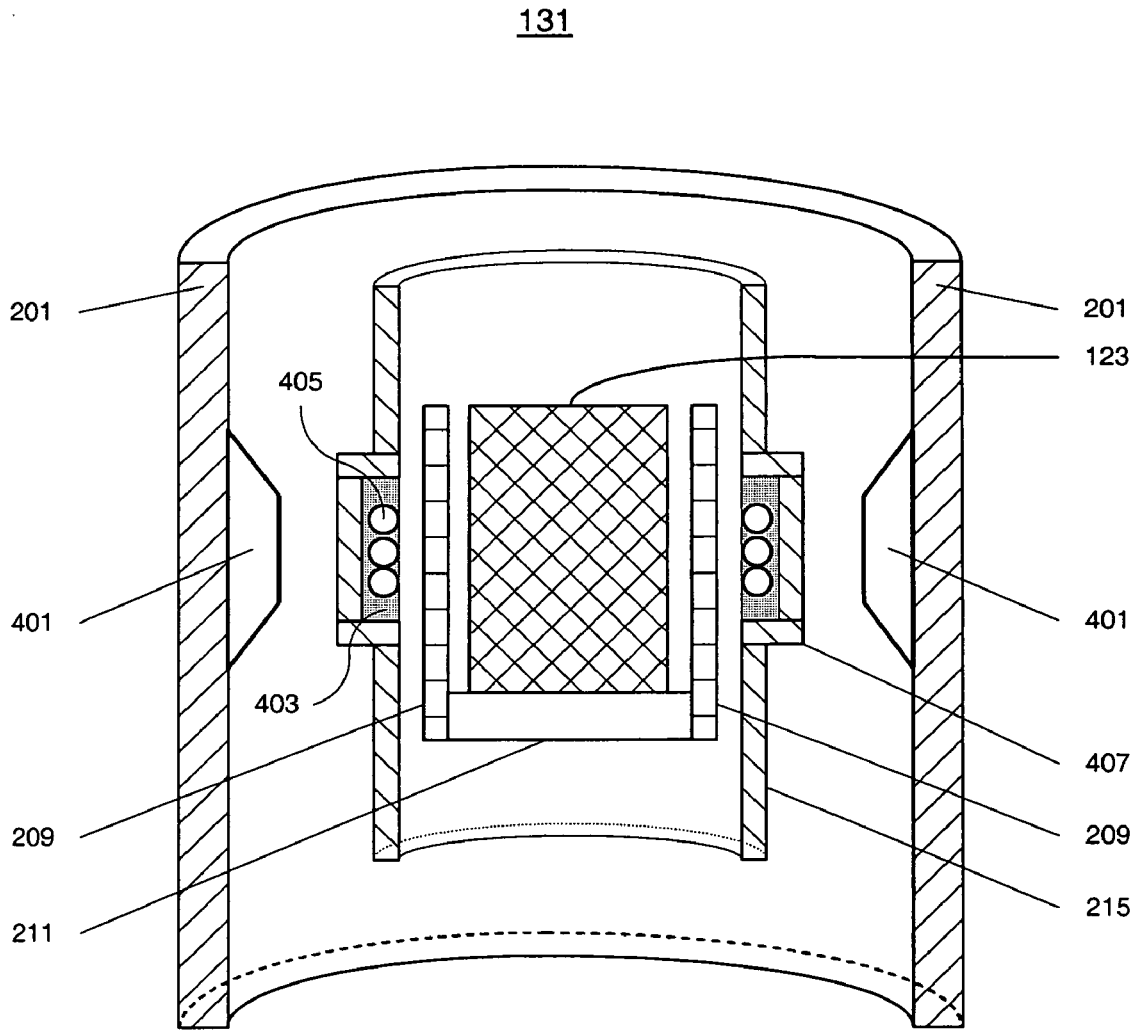
FIG. 4 is a cross-sectional view of one embodiment of a Nuclear Magnetic Resonance (NMR) unit deployed in the core analysis section of the side-coring tool illustrated in FIG. 1.

FIG. 4, by way of example, is a cross-sectional view of the core analysis section 131 of the side-coring tool 171 illustrated in FIG. 1 and is operable to detect the nuclear magnetic resonance signal from the nuclei within the side-wall core. The Nuclear Magnetic Resonance logging is described in greater detail in complimentary art, co-pending and co-assigned U.S. patent application Ser. No. 10/316,798, entitled, "NUCLEAR MAGNETIC RESONANCE METHODS AND LOGGING APPARATUS" of Hurlimann et al., the entire disclosure of which is incorporated herein by reference.

The acquired side-wall core 123 in a protective canister 137, traverses a channel guided by the core-guiding block 215 and ensures accurate placement of side-wall core 123 in the canister 137 during the measurement. The channel is defined by the inside diameter of an antenna support 403. While materials having some conductivity and some magnetism can be used in certain circumstances, in a preferred embodiment of this invention, the antenna support 403 is made of nonconductive and non-magnetic material. In an alternative embodiment of this invention, ceramic or hard polymeric materials are preferable materials for the antenna support 403. A nuclear magnetic resonance antenna 405 is embedded in the antenna support 403. The antenna 405 is operable of radiating a radio-frequency magnetic field, conventionally called $B_1$. In the embodiment illustrated in FIG. 4, the antenna 405 is a solenoid coil and generates an oscillating magnetic field parallel to the axis of the channel. The antenna support 403 is enclosed by a thick-wall metal tube 407, so as not to obstruct the channel. High frequency magnetic fields cannot penetrate metals, so the antenna 405 is placed inside the metal tube 407. It is noted that one skilled in the art would recognize that in some circumstances the metal tube 407 may be made of magnetic materials or soft magnetic materials. An array of permanent magnets 401 is placed outside the metal tube 407 wherein the magnets 401 create a static magnetic field, conventionally called $B_0$. The static magnet 401 determines the frequency of the radio-frequency $B_1$ field using the equation $v=\gamma B_0$ where $\gamma$ is the gyromagnetic ratio of the nuclei being detected. In one embodiment of this invention, the static magnetic field may be designed to be spatially uniform or with a field gradient.

In one embodiment of this invention, gradient coils, not illustrated in FIG. 4, may also be used for the purpose of making pulsed field gradient measurement of diffusion coefficient or to perform magnetic resonance imaging (MRI). If the static magnetic field is aligned with the z-axis, the most effective gradients are $dB_z/dx$, $dB_z/dy$ and $dB_z/dz$. Designing gradient coils that generate maximally uniform gradients can be found in the literature, see R. Turner, "Gradient Coil Systems", Encyclopedia of Nuclear Magnetic Resonance, 1996, incorporated by reference herein in its entirety.

IV. Interpretation of Core Analysis Results

IV.1. Gamma-Ray

The gamma-ray count rates, discussed herein above in the section entitled "Core Analysis", provide information regarding the geological properties of the acquired side-wall core. More details of the analyses, for example, bulk density of side-wall core, porosity of side-wall core and photoelectric factor measurements, are described in this section. Furthermore, in one embodiment of the invention, gamma-ray count rate provides information regarding presence or absence of a side-wall core during side-coring operation by the side-coring tool 171 at a desired depth of interest 125 in a well borehole 107. Herein, "high-energy count (HEC)" is the number of gamma-ray counts per second with a detected energy is in a range of 230-400 keV, and "low-energy count (LEC)" is the number of gamma-ray counts per second with a detected energy is in a range of 60-107 keV.

IV.2. Nuclear Magnetic Resonance

The Nuclear Magnetic Resonance is a measurement of magnetic moment of the hydrogen nuclei or protons or other nuclei. Protons have an electric charge and a weak magnetic moment. A set of permanent magnets 401, illustrated in FIG. 4, create a static, polarizing magnetic field. The time it takes to align or polarize nuclei when the canister 137 with side-wall core 123 traverses the static magnetic field is referred to as longitudinal-relaxation time, $T_1$. A series of timed radio-frequency pulses from the antenna 405 are used to manipulate the nuclear spins. When the aligned spins are tilted into a plane perpendicular to the static magnetic field, they precess around the direction of the static magnetic field. The precessing spins create oscillating magnetic fields, which generate a weak but measurable radio-frequency signal. However, this signal often decays rapidly. By repeatedly applying a sequence of radio-frequency pulses, the precessing protons generate a series of radio-frequency signal or peaks known as spin echoes. Techniques to produce spin-echo include, for example, Hahn echo and Carr-Purcell-Meiboom-Gill (CPMG) sequence. The rate at which the protons decay is called transverse-relaxation time, $T_2$.

Both $T_1$ and $T_2$ measurements sample a time evolution process. $T_1$ measurements sample buildup and $T_2$ measurements sample an exponential decay. Conventional $T_1$ measurement consists of a few samples with a series of recovery time. The $T_2$ measurement, on the other hand, captures the complete decay within a single CPMG measurement after only one wait time, resulting in a greater number of echoes per measurement. Thus, the $T_2$ measurement can be taken more quickly leading to either a higher sampling rate or to more averaging and, therefore, enhancing data quality.

The nuclear magnetic resonance measurements are made in cyclic mode. The operating cycle comprises an initial polarization wait time followed by the transmission of the radio-frequency pulses and then the reception of the coherent echo signal, or echo. The cycle of pulsing and echo reception is repeated in succession until the programmed number of echoes have been collected. In one embodiment of the invention, the CPMG sequence is executed by applying an initial 90 degree pulse followed by a long series of timed 180 degree pulses. The time interval between the successive 180 degree pulses is the echo spacing and is typically on the order of hundreds of microseconds.

The CPMGs are collected in pairs to cancel the intrinsic noise in the CPMG sequence. The first of the pair is a pulse with a positive phase. The second of the pair is collected with a 180 degree phase shift, known as a negative phase. The two CPMGs are herein combined to give a phase-altered pair. The combined or stacked CPMG has an improved signal-to-noise ratio compared with the initial CPMG sequence. The pulse parameters herein such as echo spacing, wait times and the nuclear magnetic resonance measurement cycle, define aspects of the measurement, thus, the pulse parameters are programmable.

There are several alternative embodiments for deploying NMR in a well-logging systems according to the invention. In one such alternative embodiment $T_1$ recovery and CPMG are combined to simultaneously obtain $T_1$, $T_2$ and the $T_1$-$T_2$ correlation function. In a second alternative embodiment, a diffusion technique using field gradient is combined with CPMG to allow simultaneous measurement of diffusion constant and $T_2$ Experiments for NMR measurement techniques that lay the foundation for these embodiments may be found in greater detail in complimentary art, namely, commonly assigned U.S. Pat. No. 6,462,542, and U.S. Pat. No. 6,570,382, the entire disclosures of which are incorporated herein by reference.

IV.3 Presence or Absence of Side-Wall Core

IV.3.A. Gamma-Ray

Figure 5:
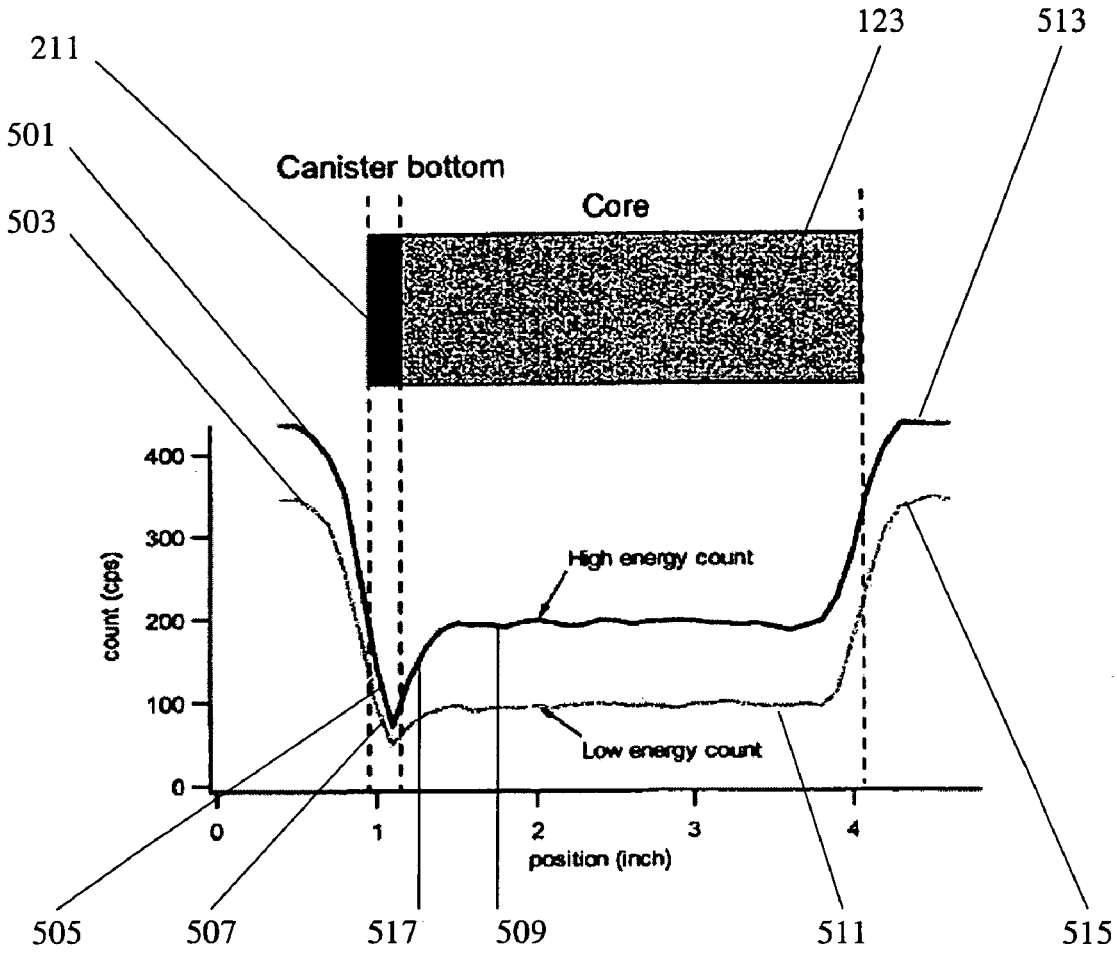
FIG. 5 is a diagram showing gamma-ray count rate change when a protective canister containing a side-wall core traverses past the measurement path of the energy detection unit and wherein one embodiment of core analysis section the sensors of FIG. 3 are a gamma-ray source and a gamma-ray detector, respectively.

In the embodiment illustrated in FIG. 5, by way of example, is a graph showing measurements of gamma-ray count rate versus position of a core. FIG. 5 illustrates a method by which measurement of gamma-ray count rate is used to determine the presence of the acquired side-wall core 123. In a preferred embodiment of the invention, the conveying speed used for scanning a protective canister 137 containing a side-wall core 123 traversing across the collimated cone 207 is 0.1 inch per 30 seconds. At a conveying speed of 0.1 inch per 30 seconds, it takes 900 seconds for a side-wall core 123 of three inches in length to traverse across the collimated cone 207. If a protective canister 137 containing a side-wall core 123 is not traversing across the collimated cone 207, higher gamma-ray count rates are initially detected whereby the high-energy count HEC, represented by 501 and the low-energy count LEC, represented by 503 in FIG. 5, wherein the count rates and scanning speed are linearly proportional to the source strength. When the protective canister bottom 211 traverses across the collimated cone 207, the gamma-rays emitted by the gamma-ray source 203 are blocked thereby reducing significantly the gamma-ray count rates, e.g., the high-energy count HEC, represented by 505, is less than 100 counts per second and low-energy count LEC, represented by 507, is less than 100 counts per second. Furthermore, when the side-wall core 123 contained in the protective canister 137 traverses across collimated cone 207, the high-energy count HEC, represented by 509, is 200 counts per second and the low-energy count LEC, represented by 511, is 100 counts per second. As the entire side-wall core 123 contained in the protective canister 137 traverses across the collimated cone 207, higher gamma-ray count rates are detected, e.g., the high-energy count HEC, represented by 513, is observed around 450 counts per second and the low-energy count LEC, represented by 515, is 350 counts per second. Thus, in the presence of a side-wall core 123 in the protective canister 137, the gamma-ray count rate changes provide information regarding the length of the acquired side-wall core. Detecting core length is relatively simple as it does not require precise density measurements. Core density and fluid density are expected to be quite different even in the presence of the heaviest mud fluid. The influences of surrounding fluid and barite are not an issue for computing the length of the acquired side-wall core 123. The length of the side-wall core 123 may be measured with an accuracy of 0.1 inch with a simple criterion, e.g. using middle point of two densities 517 as an edge of two materials, the canister bottom 211 and the side-wall core 123. Furthermore, in one embodiment, the total length of the side-wall cores acquired at desired depths of interest of well borehole 107 is calculated in near real-time and transmitted to the data acquisition and processing apparatus 105 on the surface.

Figure 6:
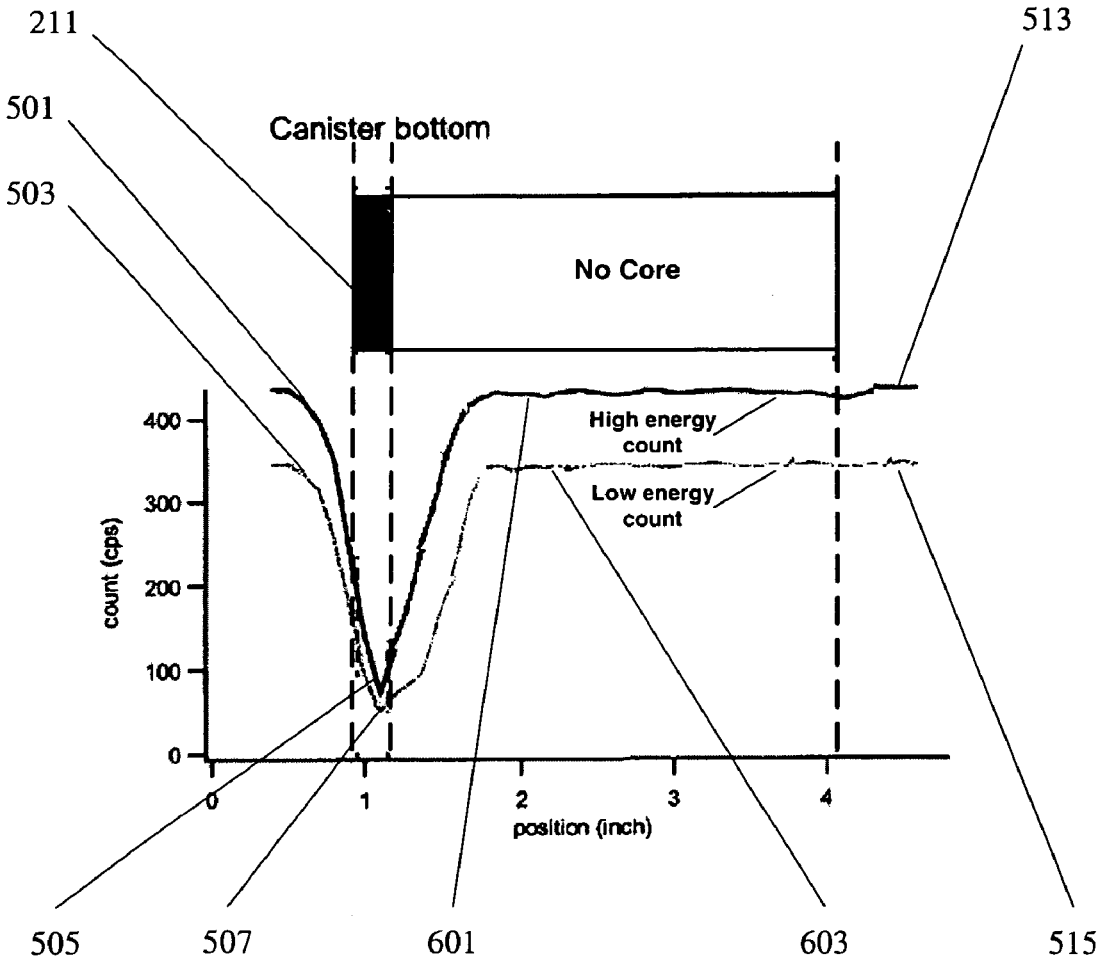
FIG. 6 is a diagram showing gamma-ray count rate change when a protective canister not containing a side-wall core traverses past the measurement path of the energy detection unit and wherein one embodiment of the core analysis section, sensors of FIG. 3 are a gamma-ray source and a gamma-ray detector, respectively.

In one embodiment of the invention, illustrated in FIG. 6, by way of example, is the illustration of a failure to acquire a side-wall core 123 at a depth of interest 125 as recorded from the detected gamma-ray count rate change. In this embodiment, the canister side-wall 209 is made up of a light material such as PEEK (plastic material Polyshell-12). When the protective canister bottom 211 traverses across the collimated cone 207, the gamma-rays emitted by the gamma-ray source 203 are blocked thereby reducing significantly the gamma-ray count rates, e.g., the high-energy count HEC, represented by 505, is less than 100 counts per second and low-energy count LEC, represented by 507, is less than 100 counts per second. Furthermore, when the protective canister 137 without the side core traverses across collimated cone 207, the high-energy count HEC, represented by 601, is observed around 450 counts and the low-energy count LEC, represented by 603, is 350 counts per second. i.e. similar to the higher gamma-ray count rates are detected when the entire side-wall core 123 contained in the protective canister 137 traverses across the collimated cone 207, represented by 513 and 515 respectively as illustrated in FIG. 5. In another embodiment, when aluminum is used as canister side-wall 209, some reduction in gamma-ray count may be observed when the protective canister 137 without the side core traverses across collimated cone 207. In this embodiment, the high-energy count HEC, represented by 601, is observed around 300 counts and the low-energy count LEC, represented by 603, is observed around 250 counts per second. The information of a failure to acquire a side-wall core at a depth of interest 125 is transmitted in near real-time to the surface data acquisition and processing apparatus 105 at the wellsite. The surface data acquisition and processing apparatus 105 in that embodiment of the invention may send a command to the coring-tool 171 via wireline 103 to re-acquire a side-wall core where the first attempt at acquiring a side-wall core had failed at the desired depth of interest 125 of the borehole 107, thereby ensuring that the side-wall core is acquired at the desired depth of interest 125 and thereby at other depths of interest in the borehole 107 according to a coring job plan.

IV.3.B. Nuclear Magnetic Resonance

The measurements of porosity, $T_1$ and $T_2$ and their distributions, $T_1$-$T_2$ and D-$T_2$ maps (see for example commonly assigned U.S. Pat. No. 6,462,542 and U.S. Pat. No. 6,570,382) are key elements of nuclear magnetic resonance logging. The raw measurements of the core analysis section 131 are further processed by the signal processing algorithm implemented in the software programs 1007 of the core analysis section 131 to perform the critical $T_1$, $T_2$, $T_1$-$T_2$, D-$T_2$ inversion process. These inversion processes provide information used to deduce the presence or absence of a side-wall core. Furthermore, the magnetic resonance imaging techniques using the constant or pulsed field gradient can be applied to obtain spatial distribution of porosity and $T_2$ in quantitatively deducing the presence, absence and extent of damage of the side-wall core.

IV.4. Side-Wall Core Bulk Density ($P_b$)

IV.4.A. Gamma-Ray

The high-energy count (HEC) referred to herein above in the section entitled "Core Analysis" may be used in one embodiment of the invention to calculate side-wall core bulk density. In that embodiment of the invention, the Compton scattering may be a dominating factor affecting gamma-ray count rate at a high-energy level. In that embodiment of the invention, the diameter of the acquired side-wall core is assumed to be constant along the entire length of the acquired side-wall core, thereby establishing the relationship between a detected gamma-ray count rate I and electron density $\rho_e$ as $I \propto \exp(-a\rho_e)$, where a is a constant proportional to the diameter of the core. Furthermore, for those elements whose ratios of atomic numbers Z to atomic weights A are the same, the electron densities $\rho_e$ are proportional to the core bulk densities $\rho_b$ and, therefore, allowing the translation of the above relationship of detected gamma-ray count rate I to $I \propto \exp(-a'\rho_b)$. Table 1 is a list of atomic numbers (Z), atomic weights (A), and the ratio Z/A for elements commonly encountered in petroleum exploration and production, and therefore, likely to be found in a side-wall core. With the exceptions of hydrogen and barium, the Z/A ratio is about 0.5 for most elements likely to be found in a side-wall core. However, hydrogen and barium are mainly found in fluid. Hydrogen exists in both water and hydrocarbon fluid in the same pore space and distorts the approximation substantially that the electron densities $\rho_e$ are proportional to the core bulk densities $\rho_b$. High-Z elements are not that common in the typical reservoir rocks such as quartz, calcite and dolomite but can be found in shale rocks. Furthermore, one embodiment of the invention recognizes that the influence of bound fluid or mud has to be compensated for, if a large amount of bound fluid or mud invasion is suspected.

TABLE 1

Atomic number (Z) and atomic weight (A) for commonly encountered elements in the oil field, (the numbers are for the most abundant elements).

| Element | Z | A | Z/A |
|---|---|---|---|
| H | 1 | 1 | 1 |
| C | 6 | 12 | 0.5 |
| O | 8 | 16 | 0.5 |
| Al | 13 | 27 | 0.48 |
| Si | 14 | 28 | 0.5 |
| Ca | 20 | 40 | 0.5 |
| Ba | 56 | 137 | 0.41 |

Figure 7:
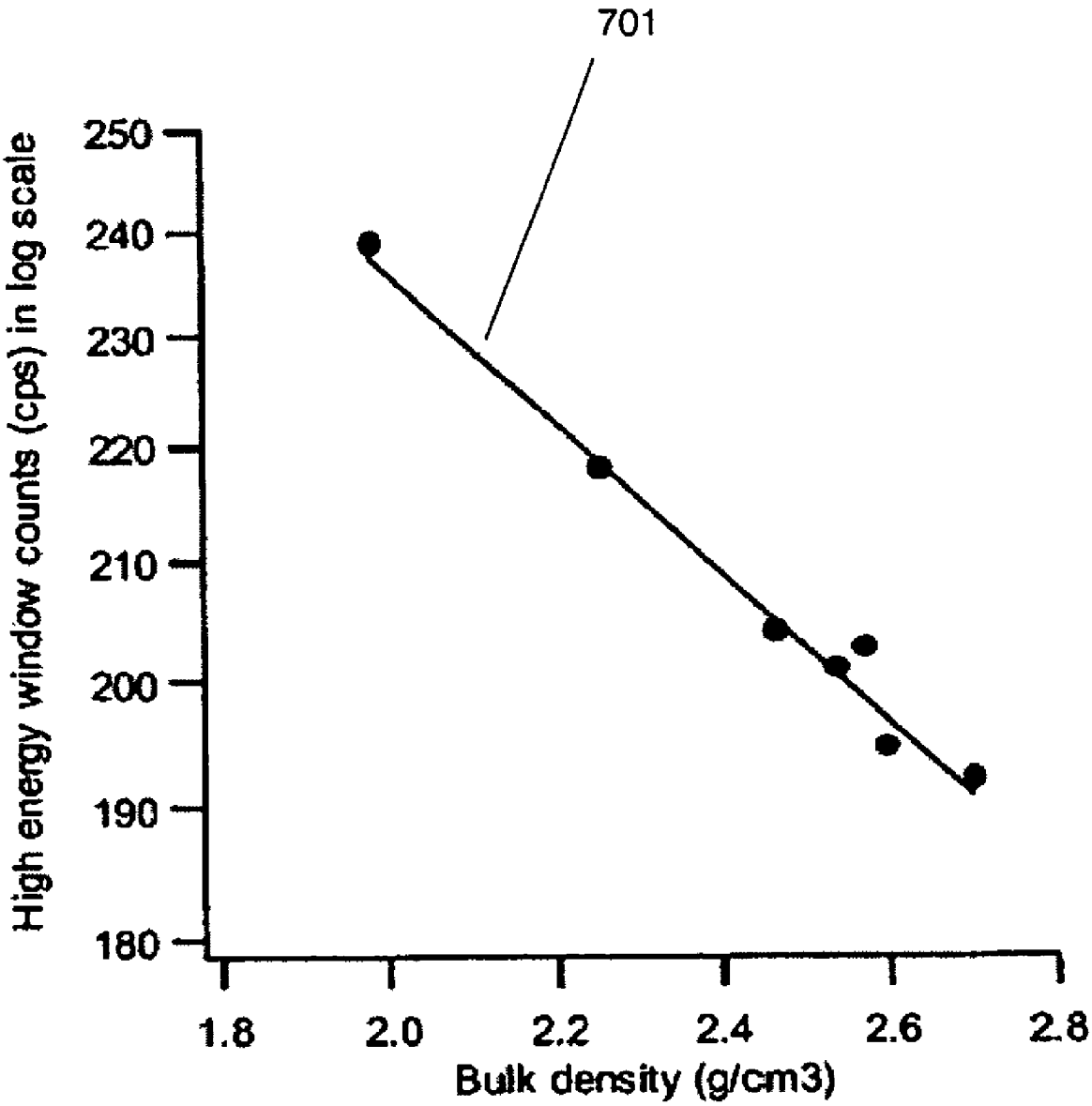
FIG. 7 is a plot showing how high-energy count rate on a log scale relates to core bulk density.

In that embodiment of the invention, illustrated in FIG. 7, by way of example, is a graph illustrating the results of an actual measurement with an exempt licensing $^{133}$Ba gamma-ray source for seven acquired side-wall cores when no bound fluid was observed and furthermore the relationship ($\log I \propto (-\rho_b)$) as represented by 701 is clearly observed.

IV.5. Photoelectric Factor (Pe) Measurement

IV.5.A. Gamma-Ray

Figure 8:
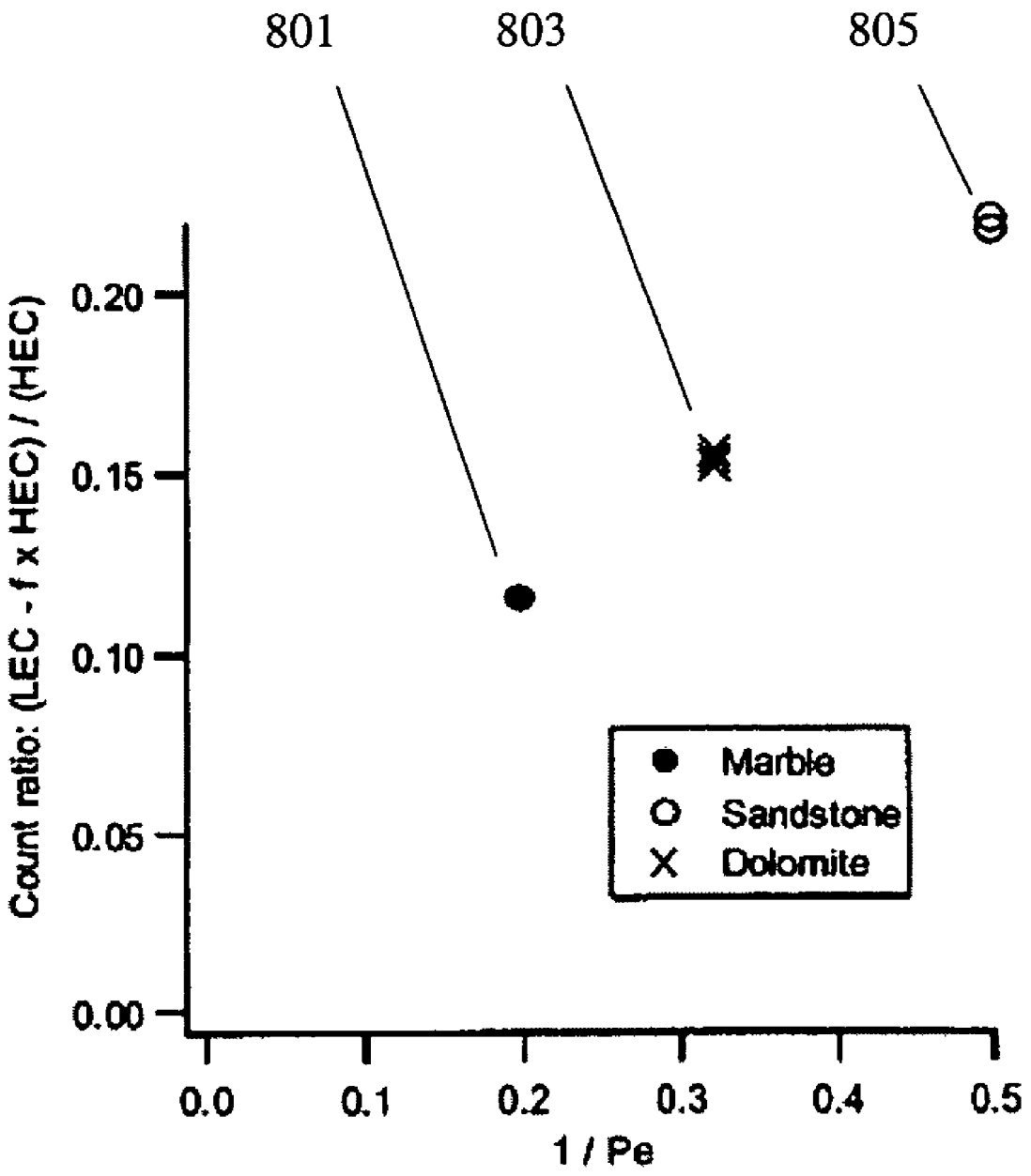
FIG. 8 is a plot showing how count ratio relates to the reciprocal of the photoelectric effect of side-wall core samples that in one embodiment contain marble, sandstone or dolomite.

In one embodiment of the invention, a Photoelectric Factor (Pe) may be calculated from a ratio of corrected background low-energy count rate (corrected LEC) to high-energy count rate (HEC). The high-energy count HEC and low-energy count LEC, referred to herein above in the section entitled "Core Analysis", are used to calculate a corrected LEC. The low-energy count rate includes the energy count rate around 80 keV and the energy-reduced gamma-rays originally belonging to the high-energy count rate due to Compton scattering referred to as continuum contribution. The continuum contribution is represented as f×HEC wherein f is a continuum coefficient and represents a constant number for each measurement. Furthermore, the influence of continuum contribution needs to be removed in defining attenuation wherein the corrected LEC is represented by (LEC−f×HEC). In that embodiment of the invention is illustrated in FIG. 8, which illustrates a chart of corrected count rate ratio ((LEC−f×HEC)/(HEC)) against (1/Pe) for acquired side-wall cores of lithography, for example, side-wall core of marble 801, dolomite 803 or sandstones 805. Furthermore, the continuum coefficient f is determined from this chart.

IV.6. Geophysical Properties of Side-Wall Cores

IV.6.A. Gamma-Ray

In one embodiment of the invention, bulk density ($\rho_b$) and matrix density ($\rho_m$) are calculated by using embodiments outlined herein above in the sections entitled "Side-wall core Bulk Density" and "Photoelectric Factor Measurement", with knowledge of the bound fluid ($\rho_f$). In that embodiment, core porosity ($\phi$) can be calculated from expression $\rho_b=\rho_m(1-\phi)+\rho_f\phi$. The porosity $\phi$ is dimensionless and is furthermore represented as a decimal between zero and unity. Solving the above equation herein for porosity yields $\phi=(\rho_b-\rho_m)/(\rho_f-\rho_m)=a\,\rho_b+b$, wherein scaling constant $a=(1/(\rho_f-\rho_m))$ and scaling constant $b=(-\rho_m(\rho_f-\rho_m))$ and furthermore scaling constants a and b depend on the parameter specific to the zone being investigated. In one embodiment of the invention, the matrix density of a sedimentary rock ranges from 2.65 g/cm$^3$ for quartz to 2.96 g/cm$^3$ for anhydrite. The fluid density may range from 1.00 to 1.40 g/cm$^3$ for water, mud filtrate or brine, depending on the salinity. The matrix density of light hydrocarbons may be as low as 0.6 g/cm$^3$ or much lower as in case of low pressure gas. Table 2 summarizes the range of matrix and fluid densities.

TABLE 2

Ranges of fluid and matrix densities

| Fluids | $\rho_f$ | Matrices | $\rho_m$ |
|---|---|---|---|
| Water | 1.0 | Limestone | 2.71 |
| Salt Water | 1.0-1.2 | Dolomite | 2.87 |
| Oil/Condensates | ~0.6-1.0 | Sandstone | 2.65 |
| Gas | ~0.4 or lower | Anhydrite | 2.96 |

IV.6.B. Nuclear Magnetic Resonance

In one embodiment of the invention, the resulting $T_2$ distribution outlined herein above in the section entitled "Interpretation of Core Analysis Results", leads to a natural measure of the porosity and pore-size distribution. The total porosity seen in acquired side-wall core comprises of free-fluid porosity with long $T_2$ components, capillary-bound water and fast decaying clay-bound water. In stationary measurements, $T_2$ can be measured down to 0.1 millisecond range.

In another embodiment of the invention, an optimal signal-processing algorithm may be implemented in the electronics of the side-coring tool 171 to perform the critical inversion processes that results in deriving the petrophysical measurement in real time, e.g. lithography-independent porosity, $T_2$ spectral distribution, and permeability. D-$T_2$ and inversion can be used to identify oil, gas, water and determine gas, oil, and water saturation, oil viscosity, pore sizes and oil compositions. These petrophysical measurements can be used in conjunction with other formation evaluation measurements to optimize wellbore placement within the reservoir.

In yet another embodiment of the invention, one or a suite of nuclear magnetic resonance measurements can be applied to the side-wall cores to determine the properties of the oils, specifically, for the heavy oil. The nuclear magnetic resonance $T_1$, $T_2$, $T_1$-$T_2$ and D-$T_2$ measurements can be used to distinguish and quantify the signals from gas, water and oil. The $T_1$, $T_2$, $T_1$-$T_2$ and D-$T_2$ map of the oils can be further analyzed to obtain the properties of oil such as saturation, viscosity, molecular composition and presence of large molecules, e.g., asphaltene. These measurement techniques are useful in analyzing heavy oils as it is often difficult to obtain reliable sample of heavy oil from the borehole by Downhole formation fluid sampling tools, such as the Modular Formation Dynamics Tester (MDT™) of Schlumberger Technology Corporation. The heavy components tend to be left behind in the borehole during extraction of the fluid from the borehole by the fluid sampling tools.

V. Workflow

V.1. Gamma-Ray

Figure 9:
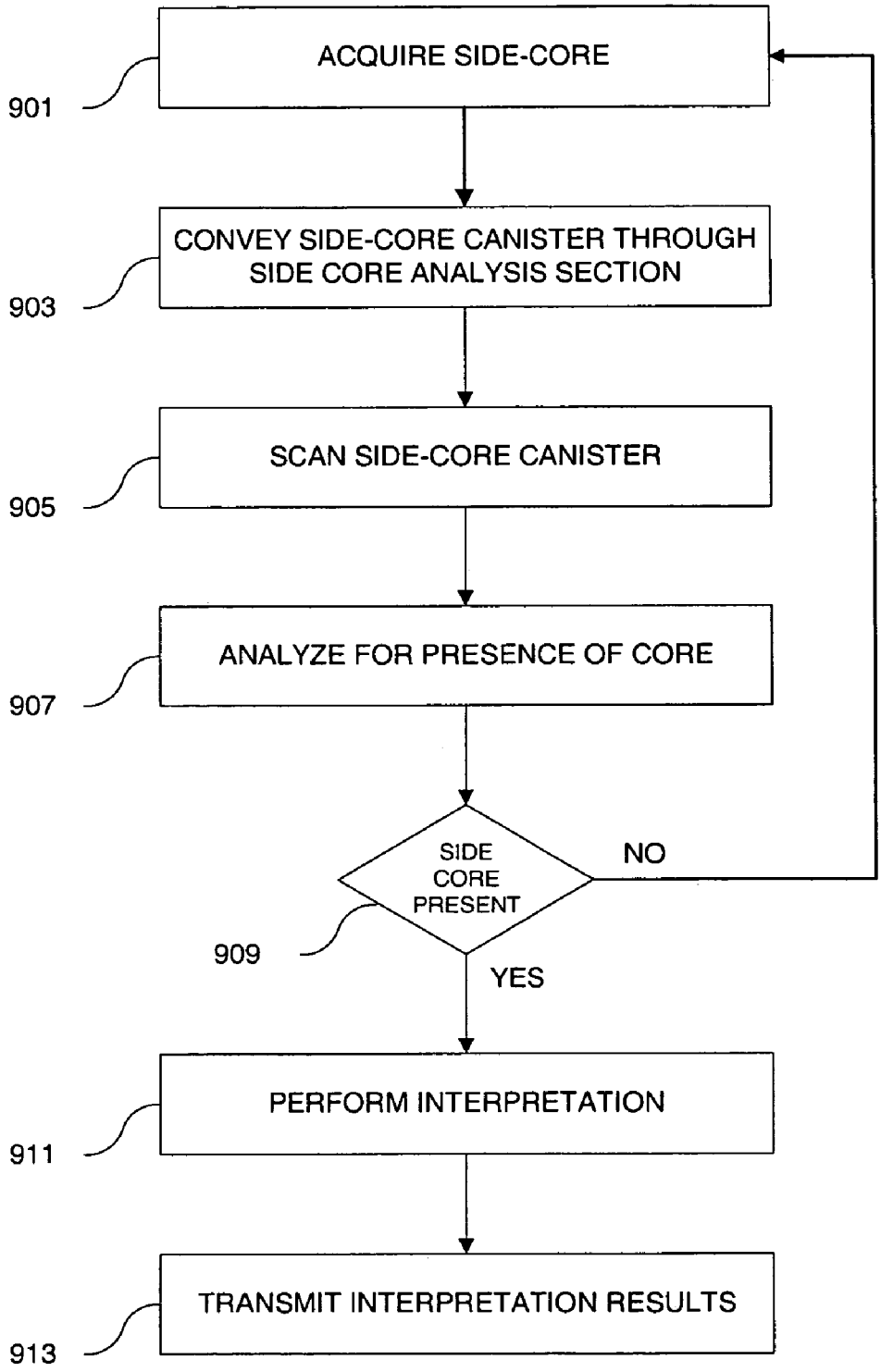
FIG. 9 is a flow-chart illustrating an exemplary method of operating an in-situ core sample analysis tool of the present invention.

FIG. 9 is a flow-chart illustrating a possible workflow for the operation of an in-situ core analysis section 131. As a first step, a side-wall core (also referred to as a "side-core") is acquired using any method suitable for obtaining side cores, for example, using the MSCT™ described above, step 901. The side-wall core is then conveyed through the core analysis section 131 for analysis, step 903. The core (or more accurately the canister that may or may not contain a core) is scanned, step 905. In the exemplary embodiment, the scanning is performed using a gamma-ray source and detector, as described herein above. Alternative embodiments utilize other forms of sensors. In the exemplary embodiment, the presence of a side-wall core is determined using the techniques described herein above in the section entitled "IV.1 Presence or Absence of Side-wall core", step 907. If it is determined that no side-wall core is present, step 909, in one embodiment the side-wall core acquisition step 901 is repeated.

Optionally, the core analysis section 131 may perform one or more down-hole interpretations, step 911. These possible interpretations include the Core Bulk Density calculation (see section IV. B Side-wall core Bulk Density ($\rho_b$) above), Photoelectric Factor (Pe) measurement (see section "IV.C Photoelectric Factor (Pe) Measurement" above, and Side-wall core Porosity ($\phi$) (see section "IV.d Side-wall core Porosity ($\phi$)" above). The interpretation results are finally transmitted to the data processing and processing apparatus 105 on the surface, step 913.

VI. Schematic

VI.1. Gamma-Ray

Figure 10:
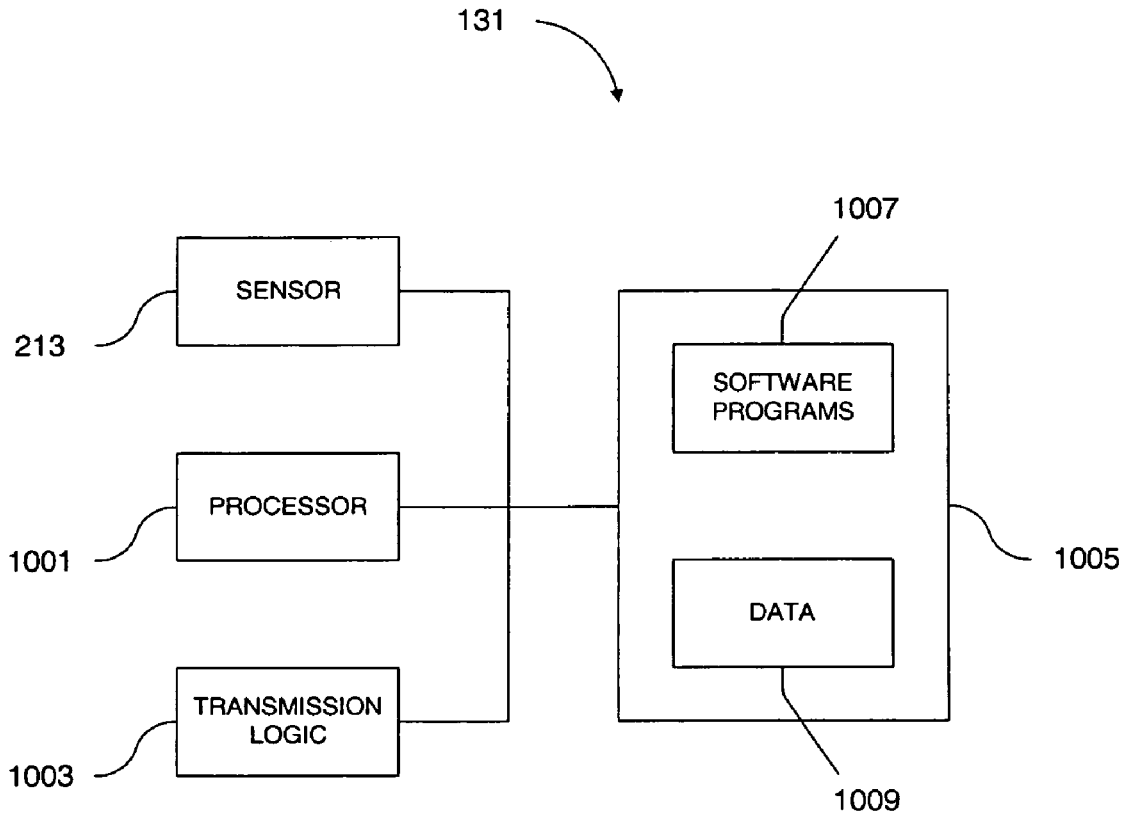
FIG. 10 is a schematic illustration of the core analysis section.

FIG. 10 is a schematic illustration of the core analysis section 131. The sensor 213 is connected to a processor 1001. The processor 1001 operates according to program instructions of software programs 1007 stored in a memory 1005. The software programs 1007 implement and control the work flow illustrated in FIG. 9 and one or more of the algorithms discussed herein above for determining whether a side-wall core is present in the canister, or one or more of the interpretations such as Core Bulk Density, Photoelectric Factor (Pe), or Side-wall core Porosity. The memory 1005 may also contain an area for storing data 1009, either parameters directing the side-wall core logging operations or the operation of any of the algorithms. The core analysis section 131 may also contain some transmission logic 1003 for performing transmission and reception of data and commands from the telemetry unit 191.

From the foregoing it will be appreciated that the method and apparatus for in-situ side-wall core sample analysis provided by the present invention represents a significant advance in the art. The present invention provides a way to cost effectively control a planned coring job, with assured reliability, using in near real-time the side-wall core analysis results, to acquire side-wall cores from desired depth of interest of geological formation of the well. In addition, delays are largely eliminated, thereby side-wall core analysis results can be used to test and update reservoir model based on the continuous log available at the well site.

Although specific embodiments of the invention have been described and illustrated, the invention is not to be limited to the specific forms or arrangements of parts so described and illustrated. The invention is limited only by the claims.

We claim:

1. A wireline-conveyed coring tool for acquiring a side-wall core from a geological formation while traversing a borehole in a well, comprising:

at least one mechanical coring unit operable to acquire a side-wall core from geological formation at one or more selected depths of interest in the borehole;

at least one core analysis unit operable to measure a geophysical property of the acquired side-wall core and determine a success or a failure of an acquisition of a side-wall core operation; and means for placing the acquired side-wall core in a protective canister having a bottom and having physical properties suitable for allowing the at least one core analysis unit to detect the presence of the canister bottom and for minimizing the interference effect of the canister wall on measurements performed by the detection unit.

2. The system of claim 1 further comprising the recording of in-situ analysis results and transmitting in near-real time the in-situ analysis results to surface data acquisition and processing apparatus.

3. The coring tool of claim 1 wherein the core analysis unit is connected to the wireline and further comprising a transmission unit for transmitting measurements or interpretation results from the core analysis unit to surface data acquisition and processing apparatus.

4. The coring tool of claim 3 wherein core analysis unit further comprises a core-guiding block to guide a protective canister containing acquired side-wall core while traversing across a collimated cone for in-situ analysis.

5. The coring tool of claim 1 wherein the core analysis unit comprises:

at least one gamma-ray source for emitting photons; and at least one gamma-ray detection unit operable to measure the change of gamma-ray count rate when an object crosses between the gamma-ray source and a gamma-ray detection unit.

6. The wring tool of claim 5 wherein the gamma-ray source of core analysis unit comprises at least one $^{133}$Ba gamma-ray source unit inside a housing.

7. The coring tool of claim 5 wherein the gamma-ray detection unit of core analysis unit comprises at least one gamma-ray detecting element.

8. The coring tool of claim 5 wherein the gamma-ray source is operable to produce photons projecting in a collimated cone and propagating along the general direction of the gamma-ray detecting element inside the gamma-ray detection unit.

9. The system of claim 5 wherein the core analysis unit comprises:

means for measuring "high-energy count (HEC)" wherein high-energy count is the number of gamma-ray counts per second of a detected energy in the range 230-400 keV; and means for measuring "low-energy count (LEC)" wherein low-energy count is the number of gamma-ray counts per second of a detected energy is in the range 60-107 keV; and means for detection of the presence of an acquired side-wall core based on variation in HEC and LEC count rate values recorded when a protective canister containing acquired side-wail core traverses across the collimated cone during in-situ analysis; and means for detection of the absence of a side-wall core based on variation in HEC and LEC count rate values recorded when a protective canister not containing a side-wall core traverses across the collimated cone during in-situ analysis.

10. The system of claim 5 wherein the core analysis unit comprises:

means for measuring "high-energy count (HEC)" wherein high-energy count is the number of gamma-ray counts per second of a detected energy in the range 230-400 keV; and means for measuring "low-energy count (LEC)" wherein low-energy count is the number of gamma-ray counts per second of a detected energy is in the range 60-107 keV; and means for performing an in-situ interpretation selected from the set including:

measurement of side-wall core bulk density ($\rho_b$) using HEC value recorded when the protective canister containing acquired side-wall core traverses across the collimated cone during in-situ analysis; and measurement of Photoelectric Factor (Pe) based on HEC and LEC values recorded when the protective canister containing acquired side-wall core traverses across the collimated cone during in-situ analysis; and measurement of side-wall core porosity ($\phi$).

11. The coring tool of claim 1 wherein the core analysis unit comprises a sensor for measuring a geophysical property selected from the set including a sensor to detect an electromagnetic property, an acoustic sensor, and a nuclear magnetic resonance sensor.

12. The coring tool of claim 11 wherein the sensor is a nuclear magnetic resonance sensor.

13. The coring tool of claim 12 wherein the nuclear magnetic resonance sensor comprises:

one or more permanent magnets to create magnetic field, and one or more radio-frequency coils; and electronics to transmit radio-frequency pulses to the radio-frequency coils and receive nuclear magnetic resonance signals from the radio-frequency coils; and means for performing nuclear magnetic resonance measurements; and means for analyzing nuclear magnetic resonance measurement data to obtain geophysical properties of acquired side-wall core.

14. The system of claim 13 further comprising gradient coils for producing magnetic field gradient operable of producing gradients along up to three orthogonal spatial directions.

15. A method of operating a wirellne-conveyed side-coring tool, the method comprising:

acquiring a side-wall core;

placing the side-wall core in a protective canister;

conveying the protective canister containing acquired side-wall core in a path proximate to a geophysical property sensor; and operating the geophysical property sensor to measure a geophysical property.

16. The method of operating a wireline-conveyed side-coring tool of claim 15 further comprising:

analyzing the measured geophysical property to determine the presence of a side-wall core in the protective canister; and analyzing the measured geophysical property to determine the absence of a side-wall core in the protective canister.

17. The method of operating a wireline-conveyed side-coring tool of claim 15 wherein the geophysical property sensor is a gamma-ray detection unit, the method further comprising:

operating a gamma-ray source to emit photons in a collimated cone;

operating a gamma-ray detection unit located adjacent to the path of the protective canister and opposite from the gamma-ray source to measure a gamma-ray count;

determining from the measured gamma-ray count whether a side-wall core is present in the canister.

18. The method of operating a wireline-conveyed side-coring tool of claim 15 further comprising:

analyzing the measured geophysical property to determine the core bulk density, photoelectric factor, and core porosity properties of the formation, and the properties of the fluid in the side-wall cores.

19. The method of operating a wireline-conveyed side-coring tool of claim 15 wherein the geophysical property sensor is a gamma-ray detection unit, the method further comprising:

operating a gamma-ray source located adjacent to the path of the protective canister to emit photons in a collimated cone;

operating a gamma-ray detection unit located adjacent to the path of the protective canister and laterally opposite from the gamma-ray source to measure a gamma-ray count;

determining from the measured gamma-ray count whether a side-wall core is present in the canister.

20. The method of operating a wireline-conveyed side-coring tool of claim 15 wherein the geophysical property sensor is a nuclear magnetic resonance unit, the method further comprising:

performing one or a suite of nuclear magnetic resonance measurements;

determining from the measured data at least one of the saturation, viscosity, presence of large molecules or composition properties of the oil in the side-wall cores.

21. The method of operating a wireline-conveyed side-coring tool of claim 15 wherein the geophysical property sensor is a nuclear magnetic resonance unit, the method further comprising:

performing one or a suite of nuclear magnetic resonance measurements;

determining from the measured data at least one porosity properties of the formation including porosity, permeability, wettability, or pore size.

22. The method of operating a wireline-conveyed side-coring tool of claim 15 wherein the geophysical property sensor is a nuclear magnetic resonance unit, the method further comprising:

performing one or a suite of nuclear magnetic resonance measurements;

determining from the measured data at least one porosity properties of the fluid including saturation, viscosity, presence of large molecules and composition properties of the fluid.

* * * * *